US007635033B2

(12) United States Patent
Lynde

(10) Patent No.: US 7,635,033 B2
(45) **Date of Patent: *Dec. 22, 2009**

(54) DOWNHOLE ABRADING TOOL HAVING TAGGANTS FOR INDICATING EXCESSIVE WEAR

(75) Inventor: Gerald Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,910

(22) Filed: Aug. 18, 2008

(65) Prior Publication Data

US 2009/0126995 A1 May 21, 2009

Related U.S. Application Data

(63) Continuation of application No. 11/479,606, filed on Jun. 30, 2006, now Pat. No. 7,464,771.

(51) Int. Cl.
*E21B 47/00* (2006.01)

(52) U.S. Cl. ..... 175/42; 166/250.12

(58) Field of Classification Search ..... 175/39, 175/42, 374; 166/250.12
See application file for complete search history.

(56) References Cited

U.S. PATENT DOCUMENTS 2,461,164 A * 2/1949 Lewis ..... 175/39
3,011,566 A * 12/1961 Graham ..... 175/39
3,155,176 A * 11/1964 Bennett ..... 175/42
3,678,883 A * 7/1972 Fischer ..... 116/208
3,865,736 A * 2/1975 Fries ..... 508/539
7,464,771 B2 * 12/2008 Lynde ..... 175/42

OTHER PUBLICATIONS

Office Action dated Feb. 20, 2008, in U.S. Appl. No. 11/496,663, U.S. Patent and Trademark Office, U.S.A.
Amendment dated Apr. 21, 2008, in U.S. Appl. No. 11/496,663, U.S. Patent and Trademark Office, U.S.A.
Office Action dated Aug. 12, 2008, in U.S. Appl. No. 11/496,663, U.S. Patent and Trademark Office, U.S.A.
Response to Office Action dated Aug. 19, 2008, in U.S. Appl. No. 11/496,663, U.S. Patent and Trademark Office, U.S.A.
Notice of Allowance and Fee(s) Due, with Notice of Allowability dated Jun. 2, 2009, in U.S. Appl. No. 11/496,663, U.S. Patent and Trademark Office, U.S.A.

* cited by examiner

*Primary Examiner*—William P Neuder
(74) *Attorney, Agent, or Firm*—Greenberg Traurig LLP; Anthony F. Matheny

(57) ABSTRACT

A downhole abrading tools has a body with a first end for connection with a rotating component of a drill string, and a cutting end for rotation in unison with the body, the cutting end having an abrading matrix containing an abrasive material for rotating engagement with an object within the well. The downhole abrading tool also includes a passage through the tool for circulating a drilling fluid. The abrading matrix includes at least one taggant embedded within the abrading matrix capable of being released by the abrading matrix into the downhole location due to wear on the abrasive material and transported to the surface location along with the drilling fluid for detection. When the taggant is released due to excessive wear, the taggant is carried from the downhole location in the well to the surface of the well where it can be detected by the operator of the tool.

19 Claims, 4 Drawing Sheets

DOWNHOLE ABRADING TOOL HAVING TAGGANTS FOR INDICATING EXCESSIVE WEAR

RELATED APPLICATION

This is a continuation of, and claims priority to, U.S. patent application Ser. No. 11/479,606 filed Jun. 30, 2006, now U.S. Pat. No. 7,464,771.

BACKGROUND

1. Field of Invention

The invention is directed to downhole abrading tools utilized in oil and gas wells to abrade objects within the well and, in particular, to downhole mills that are used to abrade, among other objects, stuck tools, bridge plugs, well tubing, and well casing disposed within the well.

2. Description of Art

In the drilling, completion, and workover of oil and gas wells, it is common to perform work downhole in the well bore with a tool which has some sort of wearable working profile interfacing with a downhole structure. Examples would be milling a downhole metal object with a milling tool, performing a washover operation with a rotary shoe, cutting through a tubular with a cutting or milling tool, or drilling through formation with a drill bit. During the performance of these operations, it is common for the working profile of the tool, such as the cutting elements mounted on its lower or outer face, to wear away. As this wear progresses, the effectiveness of the tool decreases.

It is desirable to pull the tool from the well and replace it, when the working profile has experienced a given amount of wear. The degree of wear at which it is desirable to replace the tool depends upon the type of tool and the operation being performed. Unfortunately, it is difficult or even impossible for the well operator at the surface of the well to know accurately when this given amount of wear has occurred. Often, the decision as to when to pull the tool depends substantially upon the experience of the operator. That is, the operator must estimate the amount of tool wear based on whatever is known about the time the operation has been underway, the weight on the tool, the type of downhole structure being worked, the cuttings found in the drilling fluid, or a gradual change in work string torque. None of these parameters provides a definitive indication that the wear in the working profile has progressed to a specific degree at which the operator desires to pull the tool from the well. Pulling a tool prematurely adds unnecessary trips out of the well, adding to rig time and increased costs. Pulling the tool too late gradually decreases the effectiveness of the downhole operation, also adding to rig time and increasing the cost of the operation.

Accordingly, downhole abrading tools and methods of indicating to an operator of a downhole abrading tool of excessive wear on a cutting end of the downhole abrading tool have been desired in the art. As discussed herein, the present downhole abrading tools and methods of indicating to an operator of a downhole abrading tool of excessive wear on the cutting end of a downhole abrading tool effectively and efficiently identify excessive wear on the downhole abrading tool. Therefore, the operator of the downhole abrading tool is informed of when the downhole abrading tool should be removed from the well and replaced.

SUMMARY OF INVENTION

Broadly, the invention is directed to downhole abrading tools utilized in cutting or abrading objects disposed within the well. The term "object" encompasses any physical structure that may be disposed within a well, for example, another tool that is stuck within the well, a bridge plug, the well tubing, or the well casing.

The downhole abrading tools of the invention include a taggant disposed within the cutting end, e.g., the matrix disposed at the cutting end of the tool. When exposed to the well environment due to excessive wear on the cutting end of the tool, the taggant is released from the cutting end into the well. The taggant is then transported by the drilling fluid to the surface of the well where it can then be detected by the operator of the tool. Thus, the taggants, when observed by the operator, indicate to the operator that the tool has experienced excessive wear and should be replaced.

In accordance with the invention, the foregoing advantages have been achieved through the present downhole abrading tool for use in a well. The well has a surface location and a downhole location. The downhole abrading tool comprises a body having a first end for connection with a rotating component of a drill string, and a cutting end for rotation in unison with the body, the cutting end having an abrading matrix containing an abrasive material for rotating engagement with an object within the well. The downhole abrading tool also has a passage through the tool for circulating a drilling fluid. The abrading matrix includes at least one taggant embedded within the abrading matrix capable of being released by the abrading matrix into the downhole location due to wear on the abrasive material and transported to the surface location along with the drilling fluid for detection.

A further feature of the downhole abrading tool is that at least one of the taggant may include a radio-frequency tag, a colored dye, a radioactive material, or a florescent material. Another feature of the downhole abrading tool is that the abrading matrix may include at least two taggants comprising a first taggant and a second taggant, wherein the first taggant is different from the second taggant. An additional feature of the downhole abrading tool is that the first taggant may include a colored dye and the second taggant may include a radio-frequency tag. Still another feature of the downhole abrading tool is that the first taggant may include a radio-frequency tag and the second taggant may include a radioactive element. A further feature of the downhole abrading tool is that the first taggant may include a first colored dye and the second taggant may include a second colored dye, wherein the first colored dye is different from the second colored dye.

Another feature of the downhole abrading tool is that at least one of the at least one taggant may comprise a pellet, the pellet comprising an outer shell encasing a core, the outer shell being dissolvable in the drilling fluid, and the core being an expandable material. An additional feature of the downhole abrading tool is that the expandable material may comprise a cellular polystyrene such as Styrofoam®. Still another feature of the downhole abrading tool is that the abrading matrix comprises a layer of hardfacing containing carbide particles, at least a portion of the hardfacing overlaying the at least one taggant. A further feature of the downhole abrading tool is that the cutting end may comprise at least one blade containing the abrading matrix and the at least one taggant embedded within the blade. Another feature of the downhole abrading tool is that the at least one taggant may be located within a hole formed in the cutting end of the body and the abrading matrix comprises a layer of hardfacing overlaying the at least one taggant. An additional feature of the downhole abrading tool is that the abrading matrix may include at least two taggants comprising a first taggant and a second taggant, wherein the first taggant may be disposed within the abrading matrix at a first distance from an outer cutting surface and the second taggant may be disposed within abrading matrix at a second distance from the outer cutting surface, the first distance being different from the second distance. Still another feature of the downhole abrading tool is that the at least one taggant may be formed integral with the abrading matrix. A further feature of the downhole abrading tool is that at least one of the at least one taggants may be selected from the group consisting of a colored dye, a radio-frequency tag, a radioactive material, a florescent material, a pellet having an outer shell encasing a core, the outer shell being dissolvable in a drilling fluid and the core being an expandable material, and mixtures thereof.

In accordance with the invention, the foregoing advantages also have been achieved through a downhole abrading tool for use in a well. The well has a surface location and a downhole location. The downhole abrading tool comprises a body for connection to a drill string and having a head that rotates in unison with the body against an object in the well, the head having a layer of hardfacing thereon. The downhole abrading tool also has at least one taggant located within a hole formed in the head and overlaid with at least part of the layer of hardfacing, the taggant being releasable from the body when the layer of hardfacing is worn off of the head and transportable to the surface location along with a drilling fluid.

A further feature of the downhole abrading tool is that at least one of the at least one taggants may be selected from the group consisting of a colored dye, a radio-frequency tag, a radioactive material, a florescent material, a pellet having an outer shell encasing a core, the outer shell being dissolvable in a drilling fluid and the core being an expandable material, and mixtures thereof.

In accordance with the invention, the foregoing advantages also have been achieved through the present method of abrading an object in a well. The method comprises the steps of providing a body with a cutting end having an abrading matrix; embedding a taggant in the abrading matrix; attaching the body to a drill string and lowering the drill string into the well until the cutting end contacts the object; rotating the cutting end and the body in unison with each other to abrade the object; pumping a drilling fluid through the drill string and body and circulating the drill fluid to a surface location of the well; when the abrading matrix wears to a selected point, releasing the taggant from the abrading matrix and causing the taggant to be transported to the surface location along with the drilling fluid; and detecting the taggant at the surface location.

The downhole abrading tools and methods of abrading an object in a well have the advantages of providing effective and efficient identification of excessive wear on the downhole abrading tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
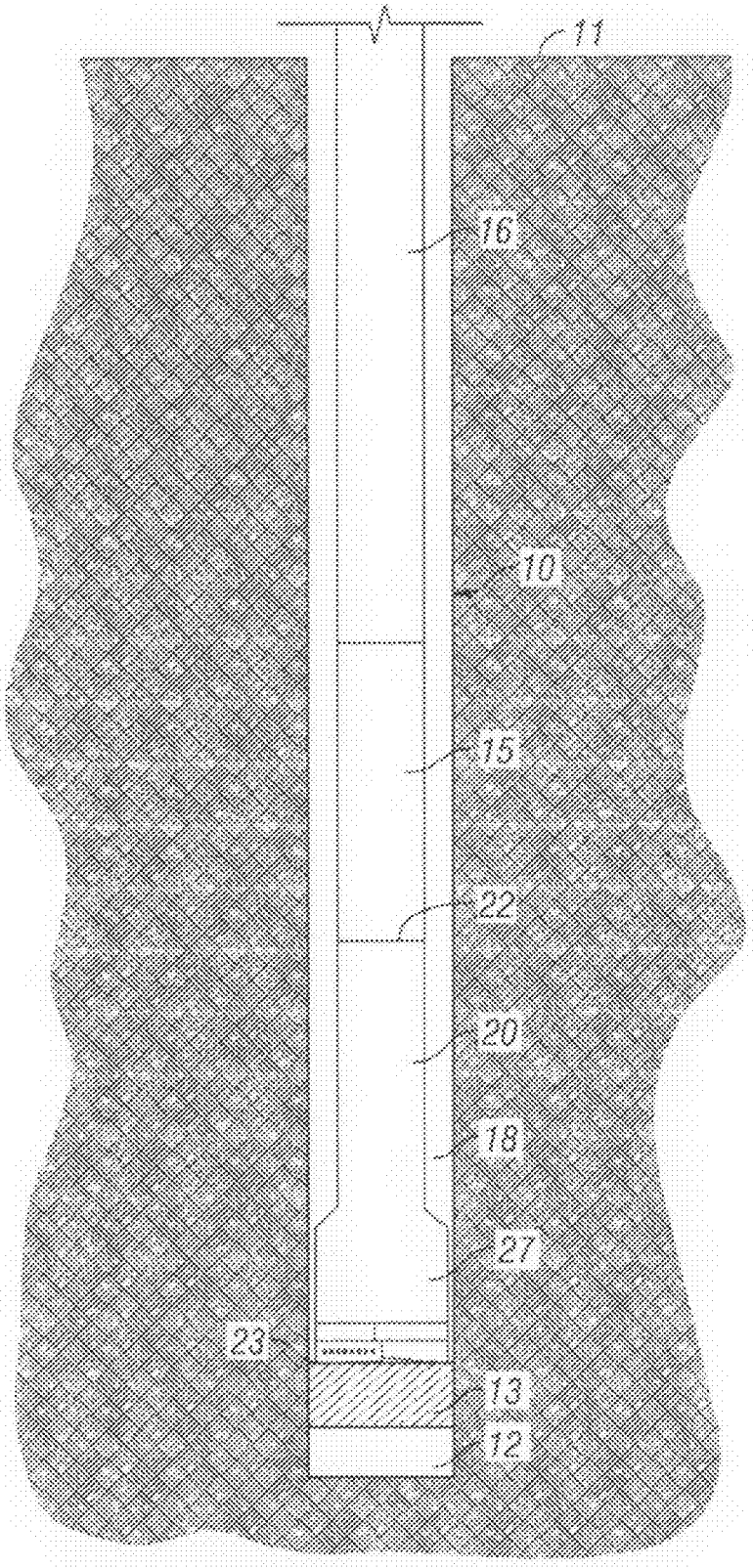
FIG. 1 is cross-sectional view of an oil or gas well having a specific embodiment of a downhole abrading tool of the present invention disposed therein.

Referring to FIG. 1, oil and gas wells 10 have a surface location 11 and a downhole location 12. Object 13 is disposed within well 10. Downhole abrading tool, or mill, 20 is connected to rotating component 15 which, together with downhole abrading tool 20, is part of drill string 16. Rotating component 15 could be a downhole drill motor. Alternatively, the entire drill string 16 rotates. Tool 20 has first end 12 and cutting end 14. Downhole abrading tool 20 is placed in contact with object 13 and then rotated, using equipment known to persons skilled in the art, to abrade object 13.

Figure 2:
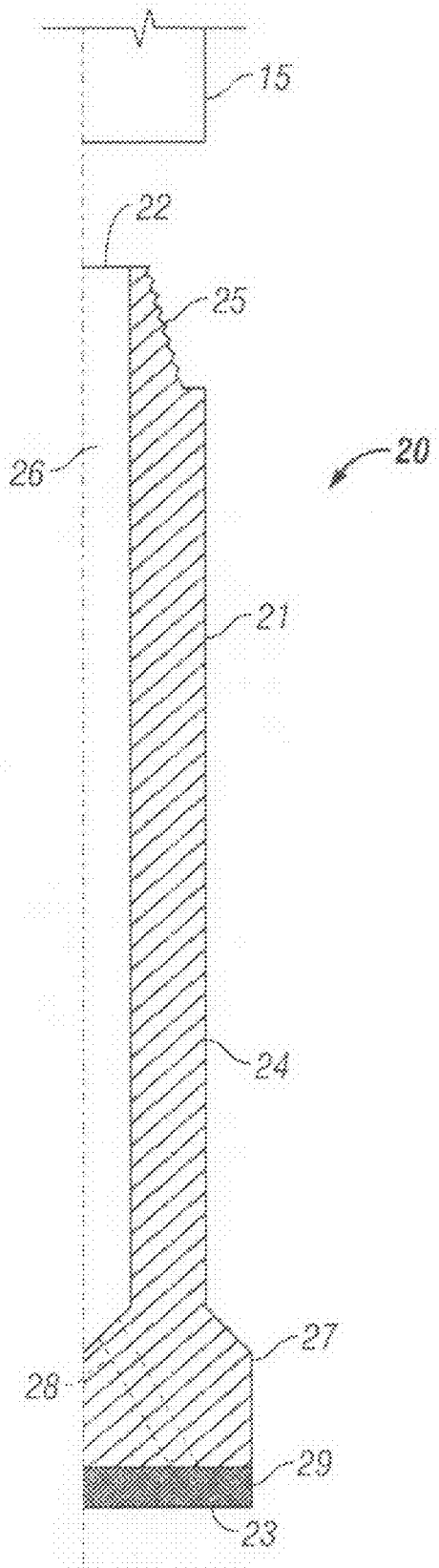
FIG. 2 is partial cross-sectional view of another specific embodiment of a downhole abrading tool of the present invention.
Figure 3:
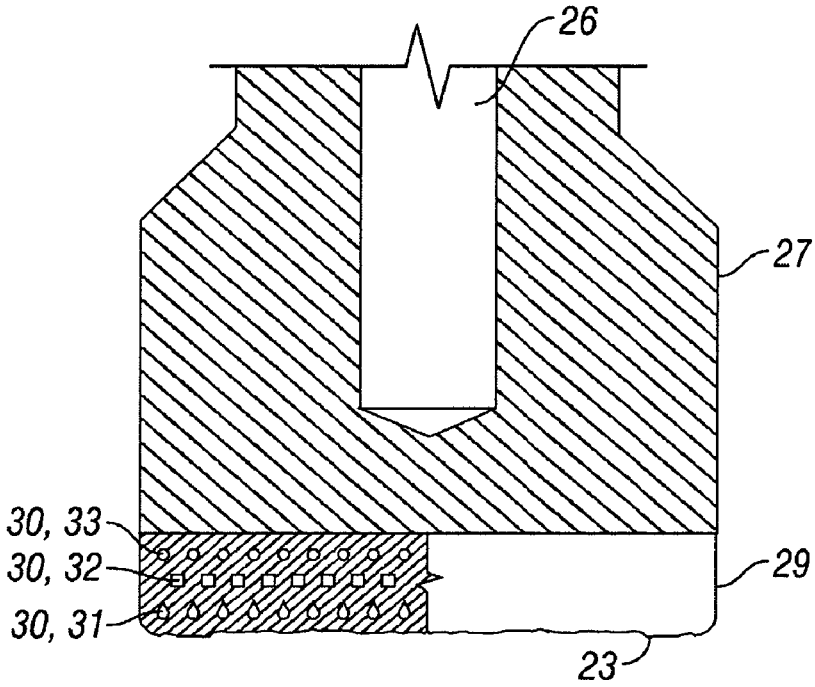
FIG. 3 is partial cross-sectional view of still another specific embodiment of a downhole abrading tool of the present invention.

As illustrated in FIGS. 2-3, downhole abrading tool 20 includes body 21, having first end 22, cutting end 23, exterior surface 24, passage 26, and head 27. First end 22 is adapted to be connected to rotating component 15 or drill string 16 to facilitate rotation of downhole abrading tool 20. First end 22 preferably includes threads 25 to facilitate attachment to rotating component 15 or drill string 16. Passage 26 is disposed longitudinally within body 20 to permit drilling fluid to flow through downhole abrading tool 20. Accordingly, drilling fluid (not shown) flows from equipment (not shown) located at surface 11, through drill string 16, through passage 26, and through drilling fluid nozzles 28 (shown in dashed lines) into well environment 18 and back up to the surface location 11. The drilling fluid facilitates cutting by downhole abrading tool 20.

Cutting end 23 includes abrading matrix 29 formed of an abrading material, such as hardfacing or other cutting material known in the art, having one or more taggants 30 disposed or embedded therein. Each taggant 30 may be, for example, a colored dye, a radio-frequency tag, a radioactive material, a florescent material, or a pellet having an outer shell that is dissolvable in the drilling fluid encasing a core formed of an expandable material such as a cellular polystyrene such as Styrofoam®. As abrading matrix 29 is worn away due to excessive wear on cutting end 23 of downhole abrading tool 20, one or more taggant 30 is released from abrading matrix 29 into well environment 18 and, thus, into the drilling fluid. As the drilling fluid circulates up well 10 to surface location 11, it carries with it each of the released taggants 30. Upon reaching surface location 11, taggants 30 are detected by an operator of the downhole abrading tool 20, either visually, or using equipment designed specifically for the detection of taggant 30. Identification of taggants 30 by the operator provides an indication that downhole abrading tool 20 has experienced excessive wear. Subsequent to the operator detecting the released taggants 30, the operator will remove downhole abrading tool 20 from well 10 to replace downhole abrading tool 20.

In one specific embodiment, taggants 30 may be formed integral with the abrading material that forms abrading matrix 29. In other words, in this embodiment, taggants 30 are embedded or disposed within abrading matrix 29 during the formation of abrading matrix 29.

As shown in FIG. 3, different taggants 30 are disposed at different locations within abrading matrix 29, thereby providing different indications as to the extent of wear on cutting end 23. For example, taggants 31 are released prior to taggants 32 and taggants 32 are released prior to taggants 33. Accordingly, an operator is provided with incremental indication as to the wear on cutting end 23. Alternatively, taggants 31, 32, and 33 can be disposed in specific areas of abrading matrix 29, e.g., taggants 31 on the sides, taggants 32 on the bottom, and taggants 33 in the middle so that an indication can be made as to the specific area or region of cutting end 23 undergoing wear.

Various combinations of the different types of taggants 30 can be used to better educate the operator as to the location of the excessive wear on cutting end 23 as well as the degree of wear occurring at various locations of cutting end 23. For example, taggants 30 having colored dyes may be released if excessive wear occurs on the outer portions of abrading matrix 29 and taggants 30 having radio-frequency tags may be released if excessive wear occurs on the center portion of abrading matrix 29.

Figure 4:
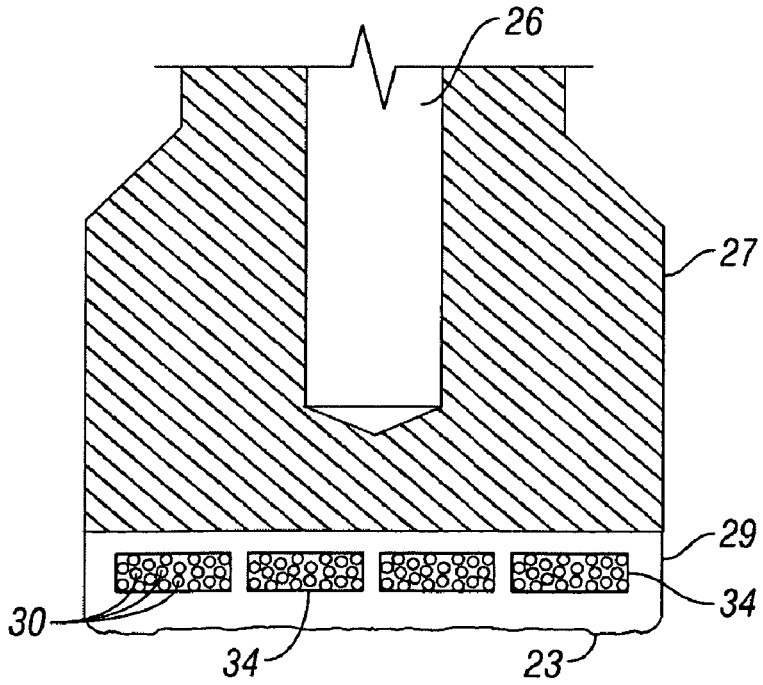
FIG. 4 is cross-sectional view of yet another specific embodiment of a downhole abrading tool of the present invention.

As illustrated in FIG. 4, taggants 30 may be disposed within taggant chambers 34 located within abrading matrix 29. Each taggant chamber 34 may be formed simultaneously with the formation of abrading matrix 29 or may be overlaid with an abrasive material that forms abrading matrix 29. When excessive wear of abrading matrix 29 occurs, taggant chamber 34 is exposed to well environment 18 such that taggants 30 are released from abrading matrix 29 and into well environment 18. As a result, taggants 30 are carried with the drilling fluid from downhole location 12 to surface location 11 for detection by the operator.

Figure 5:
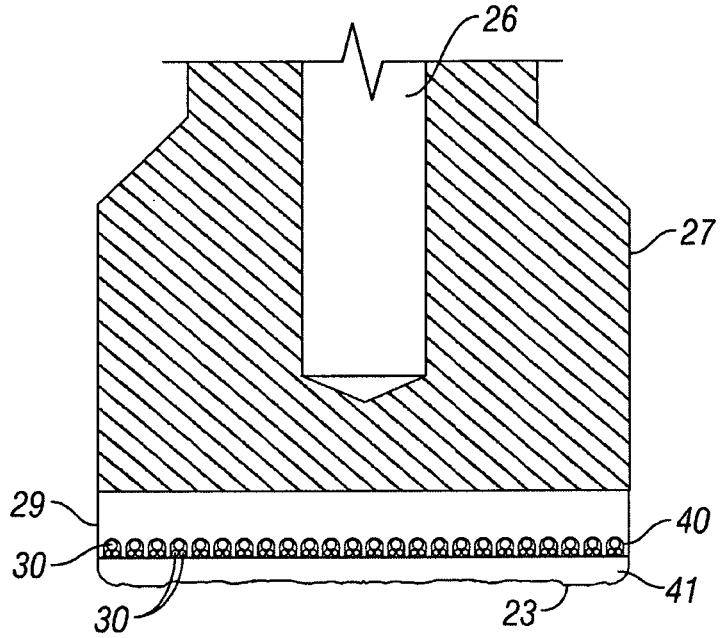
FIG. 5 is cross-sectional view of a further specific embodiment of a downhole abrading tool of the present invention.

In another specific embodiment shown in FIG. 5, abrading matrix 29 includes holes 40 having one or more taggant 30 disposed therein. Each hole 40 is formed by drilling into abrading matrix 29. One or more taggant 30 is then disposed within each hole 40 and overlaid with an abrasive material that forms abrading matrix 29. When excessive wear of abrading matrix 29 occurs, holes 40 are exposed to well environment 18 and taggants 30 are released from abrading matrix 29 and into well environment 18. As a result, taggants are carried with the drilling fluid from downhole location 12 to surface location 11 for detection by the operator.

In another specific embodiment (not shown), downhole abrading tool 20 includes a piston chamber disposed in fluid communication with taggant chamber 34 or hole 40. A piston element is slidably disposed within piston chamber and piston chamber is designed in a manner such that upon breach of taggant chamber 34 or hole 40 due to excessive wear, the piston element moves within the piston chamber to facilitate forcing taggants 30 out of taggant chamber 34 or hole 40.

Figure 6:
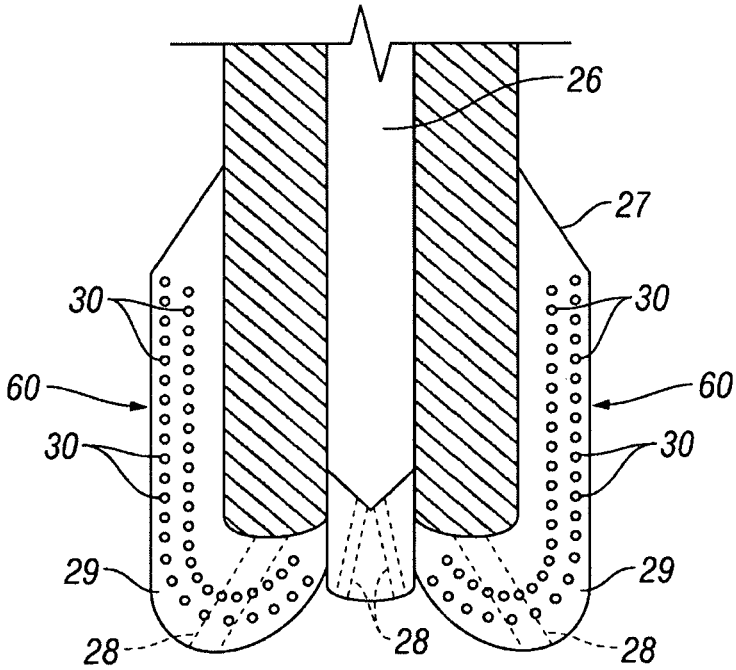
FIG. 6 is a cross-sectional view of an additional specific embodiment of a downhole abrading tool of the present invention.

As will be understood by persons skilled in the art, downhole abrading tool 20 may abrade objects in numerous different ways utilizing numerous different structurally designed heads 27 and abrading matrixes 29. For example, as shown in FIG. 6, downhole abrading tool 20 includes blades 60 having taggants 30 disposed therein. Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A downhole abrading tool for use in a well, the well having a surface location and a downhole location, the downhole abrading tool comprising:

a body having a first end for connection with a rotating component of a drill string, and a cutting end for rotation in unison with the body, the cutting end having an abrading matrix containing an abrasive material for rotating engagement with an object within the well; and a passage through the tool for circulating a drilling fluid;

wherein the abrasive material includes at least one taggant embedded integrally within the abrasive material capable of being released by the abrasive material into the downhole location due to wear on the abrasive material and transported to the surface location along with the drilling fluid for detection.

2. The downhole abrading tool of claim 1, wherein at least one of the at least one taggant includes a radio-frequency tag.

3. The downhole abrading tool of claim 1, wherein at least one of the at least one taggant includes a colored dye.

4. The downhole abrading tool of claim 1, wherein at least one of the at least one taggant includes a radioactive material.

5. The downhole abrading tool of claim 1, wherein at least one of the at least one taggants includes a florescent material.

6. The downhole abrading tool of claim 1, wherein the abrasive material includes at least two taggants comprising at least a first taggant and at least a second taggant, and wherein the first taggant is different from the second taggant.

7. The downhole abrading tool of claim 6, wherein the first taggant includes a colored dye and the second taggant includes a radio-frequency tag.

8. The downhole abrading tool of claim 6, wherein the first taggant includes a radio-frequency tag and the second taggant includes a radioactive element.

9. The downhole abrading tool of claim 6, wherein the first taggant includes a first colored dye and the second taggant includes a second colored dye, wherein the first colored dye is different from the second colored dye.

10. The downhole abrading tool of claim 1, wherein at least one of the at least one taggant comprises a pellet, the pellet comprising an outer shell encasing a core, the outer shell being dissolvable in the drilling fluid, and the core being an expandable material.

11. The downhole abrading tool of claim 10, wherein the expandable material comprises a cellular polystyrene.

12. The downhole abrading tool of claim 1, wherein the abrasive material comprises a layer of hardfacing containing carbide particles, at least a portion of the hardfacing overlaying the at least one taggant.

13. The downhole abrading tool of claim 1, wherein the cutting end comprises at least one blade containing the abrasive material and the at least one taggant embedded within the blade.

14. The downhole abrading tool of claim 1, wherein the abrasive material includes at least two taggants comprising at least a first taggant and at least a second taggant, and wherein the first taggant is disposed within the abrasive material at a first distance from an outer cutting surface and the second taggant is disposed within the abrasive material at a second distance from the outer cutting surface, the first distance being different from the second distance.

15. The downhole abrading tool of claim 1, wherein the at least one taggant is formed integral with the abrasive material.

16. The downhole abrading tool of claim 15, wherein at least one of the at least one taggants is selected from the group consisting of a colored dye, a radio-frequency tag, a radioactive material, a florescent material, a pellet having an outer shell encasing a core, the outer shell being dissolvable in a drilling fluid and the core being an expandable material, and mixtures thereof.

17. A downhole abrading tool for use in a well, the well having a surface location and a downhole location, the downhole abrading tool comprising:

a body for connection to a drill string and having a head that rotates in unison with the body against an object in the well, the head having a layer of hardfacing thereon; and at least one taggant embedded integrally within the layer of hardfacing, the taggant being releasable from the layer of hardfacing when the layer of hardfacing is worn off of the head and transportable to the surface location along with a drilling fluid.

18. The downhole abrading tool of claim 17, wherein at least one of the at least one taggant is selected from the group consisting of a colored dye, a radio-frequency tag, a radioactive material, a florescent material, a pellet having an outer shell encasing a core, the outer shell being dissolvable in a drilling fluid and the core being an expandable material, and mixtures thereof.

19. A method of abrading an object in a well comprising the steps of:

providing a body with a cutting end having an abrading matrix comprising an abrasive material;

embedding integrally a taggant in the abrasive material;

attaching the body to a drill string and lowering the drill string into the well until the cutting end contacts the object;

rotating the cutting end and the body in unison with each other to abrade the object;

pumping a drilling fluid through the drill string and body and circulating the drill fluid to a surface location of the well;

when the abrasive material wears to a selected point, releasing the taggant from the abrasive material and causing the taggant to be transported to the surface location along with the drilling fluid; and detecting the taggant at the surface location.

* * * * *